United States Patent [19]

Thorpe

[11] Patent Number: 4,732,012

[45] Date of Patent: Mar. 22, 1988

[54] ENERGY EFFICIENT EVAPORATIVE COOLER COVER APPARATUS

[76] Inventor: W. Dean Thorpe, 1615 N. Delaward, Space #44, Apache Junction, Ariz. 85220

[21] Appl. No.: 850,258

[22] Filed: Apr. 10, 1986

[51] Int. Cl.[4] ..... F28D 5/00

[52] U.S. Cl. ..... 62/304; 62/259.4; 62/DIG. 13; 62/DIG. 16; 98/119

[58] Field of Search ..... 62/259.1, 259.4, 304, 62/309, 310, DIG. 13, DIG. 16; 98/39.1, 94.2, 119; 135/93; 261/29, 30, 95, DIG. 3, DIG. 43; 248/100, 101

[56] References Cited

U.S. PATENT DOCUMENTS

| | | | |
|---|---|---|---|
| 3,011,424 | 12/1961 | Kohnen | 98/94.2 |
| 3,348,365 | 10/1967 | Dupre | 98/94.2 X |
| 3,379,481 | 4/1968 | Fisher | 312/100 |
| 4,332,114 | 6/1982 | Goebel et al. | 98/119 X |
| 4,376,082 | 3/1983 | Heck | 62/259.4 X |
| 4,389,827 | 6/1983 | Van Valkenburg | 98/94.2 X |
| 4,483,102 | 11/1984 | Edwards | 98/119 X |
| 4,502,368 | 3/1985 | Hempel | 98/29 |
| 4,520,715 | 6/1985 | Coomes et al. | 98/101 |

*Primary Examiner*—Harold Joyce

*Attorney, Agent, or Firm*—Charles P. Padgett, Jr.

[57] ABSTRACT

An energy-saving cover for evaporative coolers. An oversized top portion provides a sufficient overhang about all four sides of the cooler for shading purposes. An insulative side panel is associated with each of the sides of the cooler and the panels are positioned a predetermined distance away to allow sufficient air flow to improve the cooling efficiency of the cooler during the cooling season. During the heating season the side panels may be repositioned onto close flush against the sides of the cooler so as to seal the vent portions thereof and prevent the escape of warm air from the dwelling through the duct system. Additionally an interior duct cover can be used to seal the cooling vent to prevent the escape of warm air from the room having the cooling vent thereby saving energy and increasing heating efficiency in the heating season.

21 Claims, 6 Drawing Figures

FIG. 1
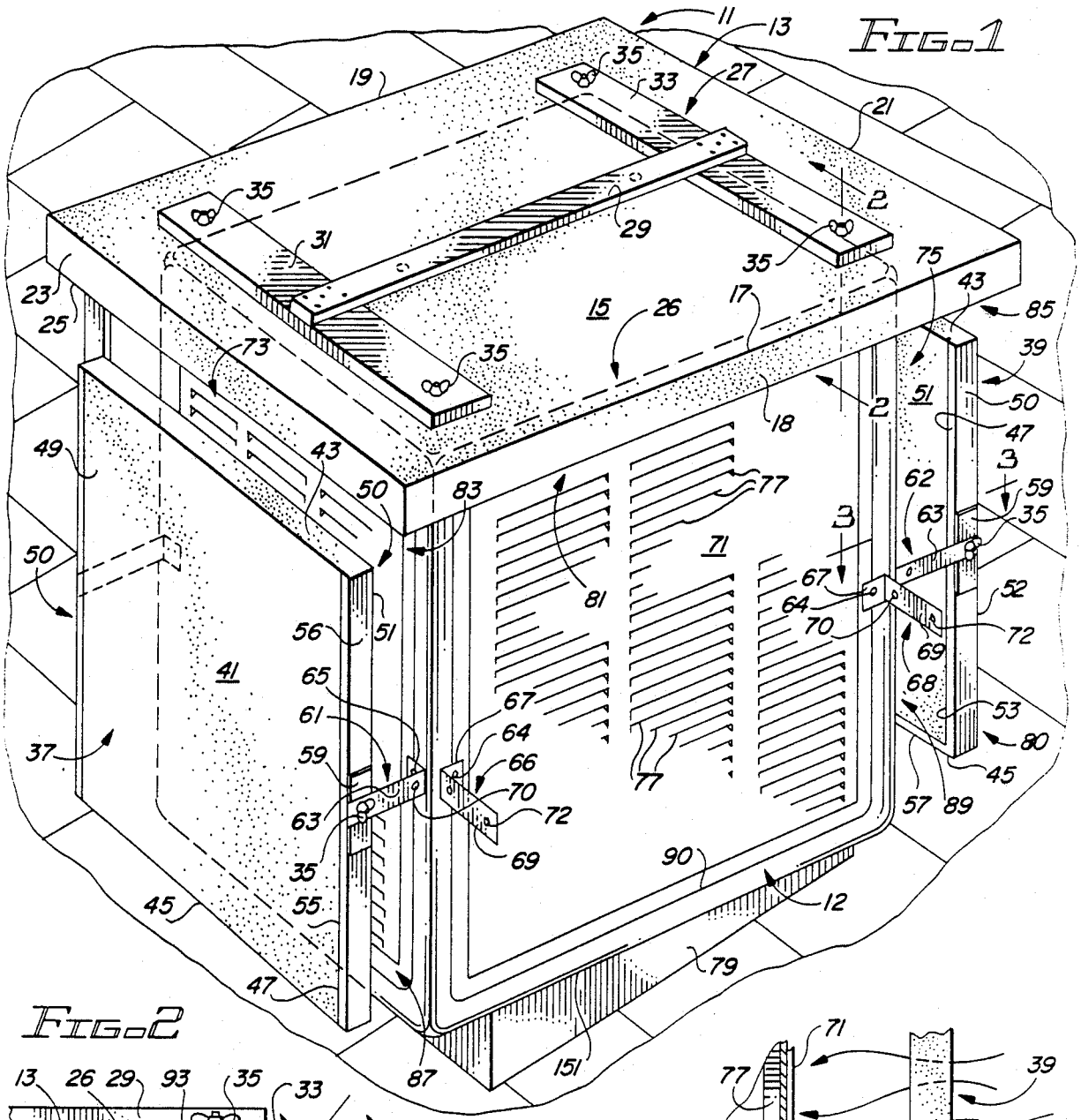
FIG. 2
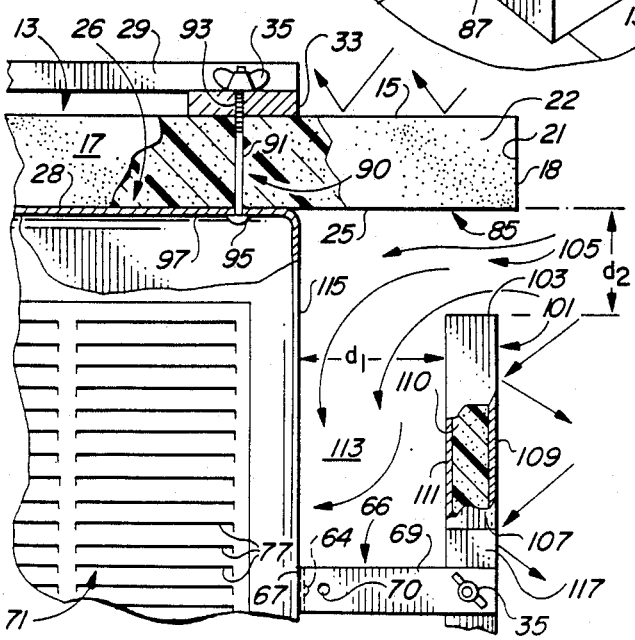
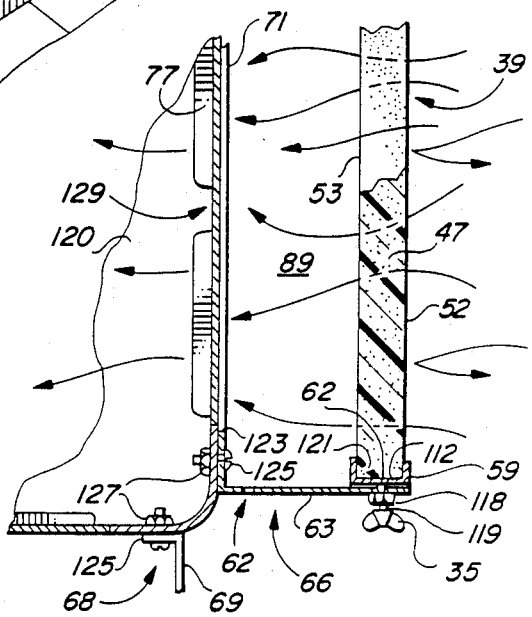
FIG. 3

ENERGY EFFICIENT EVAPORATIVE COOLER COVER APPARATUS

BACKGROUND OF THE INVENTION

1. Field of the Invention

The present invention relates generally to a cover apparatus for evaporative cooler systems, and more particularly to an evaporative cooler cover apparatus having an oversized top insulation panel which overhangs the cooler for providing shade and four retractable side-insulating panels which can be positioned a predetermined distance away from the sides of the cooler for saving energy and increasing the quantity of cool air produced in a cooling season and retracted to a sealing position flush against the side surface of the evaporative cooler for preventing loss of heat during the heating season.

2. Description of the Prior Art

The prior art adds to the problem of heat loss in the heating season and loss of cooling efficiency in the cooling season because many manufactures and installers of evaporative coolers compound the problem by painting the cooler, and any exposed ductwork, with a dark colored pain that draws heat rather than reflects it. It is not unusual on a 95° day for the surface temperature of these coolers to reach or exceed 125° thus creating a furnace plenumn chamber for the cooling air and through which the cooling air must first pass through before it enters the dwelling.

There does not exist any tpe of cooler cover assembly or apparatus which will provide cooler air for increasing the comfort level in the cooling season and such attempts as set forth above compound the problem and actually lessen the efficiency and increase the energy used by today's evaporative coolers.

The present invention solves substantially all of the problems of the prior art while avoiding many of the shortcomings and inefficiencies thereof.

BRIEF SUMMARY OF THE INVENTION

It is an object of the present invention to provide a cover apparatus for an evaporative cooler which enables the evaporative cooler or "swamp cooler" to work more efficiency and produce more cooler air for the dwelling.

It is another object of the present invention to provide a cover apparatus for an evaporative cooler which increases the efficiency of the cooler and produces much cooler air by reducing the heat normally received from the cooler through conduction, convection, and radiation.

It is a further object of the present invention to provide an evaporative cooler cover which reduces the transfer by all three of conduction, convection and radiation.

It is still another object of the present invention to provide an evaporative cooler cover which can be installed or any size or model of cooler including both side draft and wall units or on side draft units such as mounted on walls and in windows, or on downdraft units such as mounted on a roof or in the attic.

It is yet another object of the present invention to provide a cover assembly for an evaporative cooler which has no known moving parts, nothing to wear out, and which will, therefore, last for many years.

It is yet a further object of the present invention to provide a cover apparatus for an evaporative cooler which has a top insulation panel having substantially greater dimensions than the top of the cooler for providing at least a predetermined overhang on all sides of the evaporative cooler for shading and cooling purposes.

It is still a further object of the present invention to provide an evaporative cooler cover whose sides include retractable or repositionable insulation panels which can be positioned away from the sides of the cooler during the cooling season for increasing fuel efficiency and providing cooler air to the interior of the dwelling, while simultaneously sealing the cooler to prevent heat loss from the interior during the heating season.

It is still another object of the present invention to provide an evaporative cooler cover for an evaporative cooler to enable it to produce discharge air that it is 3°–7° cooler than the exact unit without the cover.

It is another object of the present invention to provide a cover apparatus for an evaporative cooler which serves the two-fold function of (1) conserving fuel and electricity, and (2) providing cooler air to increase the comfort level within the dwelling while simultaneously being of a relatively low cost and being easy to install and maintain.

It is yet a further object of the present invention to provide an insulative cover for the interior duct vents or registers of the dwelling which is easy to install and which seals the vent to prevent the escape of hot air during the heating season.

The present invention provides an insulative cover for an evaporative cooler having a top, a bottom operatively disposed on a base support means and four generally rectangular or square sides. The cover apparatus of the present invention includes a top panel of insulating material, with the panel being dimensioned substantially greater than the top surface of the evaporative cooler to provide a substantial overhang about all four sides of the cooler for shading and cooling purposes. The cover includes means for operatively coupling the top panel, for securing it to the top of the evaporative cooler four generally rectangular side panels of insulating material.

One of the side panels are associated with each of the sides of the cooler and dimensions at least completely covered the interior or mid portion of the sides of the cooler which contain the vents. A pair of bracket means are provided on each of the sides of the cooler for operatively positioning or mounting one of the side panels a predetermined distance away from the evaporative cooler side so that the side panel of insulating material is positioned generally parallel to the plane of the side of the cooler and a predetermined distance away for reducing the amount of electrical energy required for operating the cooler thereby conserving fuel in the cooling season; while simultaneously providing more air at a lower temperature in the dwelling to increase the comfort level therein. The side panels are repositionable or retractable along the bracket means so they can be manually disconnected from the spaced distance and moved flush against the sides of the evaporative cooler for sealing the vented midportions of the sides of the cooler to prevent the escape of heat from the cooler during the heating season.

A foam rubber seal may be provided on the cooler around each of the vented mid portions for ensuring that when the side panels are positioned by the bracket means flush against the sides of the cooler, an airtight seal is formed to totally prevent or at least minimize heat loss therefrom. In the preferred embodiment, the top panel of the cover apparatus includes insulating material such as polyisocyanurate approximately two inches thick. This material is relatively rigid, does not deteriorate and contains its rigidity in form over long periods of time. It is lightweight and easy to handle and has a very high structural strength. It will not cause odors, and it resists most fungus. The material is typically commercially available from American Western or a company such as Thermal Systems. It is used as standard roof insulation and is a Class A approved insulation board. It includes an isocyanurate/urethane foam core bonded chemically in the manufacturing process to facers. In the present example, the top panel is provided with fiberglass facings. The side panels are approximately one inch thick, and the end sides, but not the top and bottom sides, of each side panels are fitted into U-shaped channels made from aluminum or galvanized channel members. The bottom of the channels are then crimped to keep the panels from sliding down.

The invention also contemplates the use of a box-like structure, open at one end and of the same type insulating panels that is provided with coupling means while a corresponding coupling means is attached to the ceiling or wall of a room within the dwelling without a conventional duct opening or register so that the unit can be quickly and easily placed over the duct aperture during the heating season to substantially totally prevent the escape of hot air from the dwelling. It is removed during the cooling season so that the vent can supply the cool air to the room.

These and other objects and advantages of the present invention will be more fully understood from reviewing the detailed description of the preferred embodiment of the present invention, the claims, and the drawings which are briefly described hereinbelow.

BRIEF DESCRIPTION OF THE DRAWINGS

FIG. 1 is a perspective view of the evaporative cooler cover apparatus of the present invention minus the front panel;

FIG. 2 is a partial front view partially in section, of a portion of the cover apparatus along lines 2—2 of FIG. 1;

FIG. 3 is a sectional side view of another portion of the cover apparatus of along line 3—3 of FIG. 1;

DETAILED DESCRIPTION OF THE PREFERRED EMBODIMENT

Figure 4:
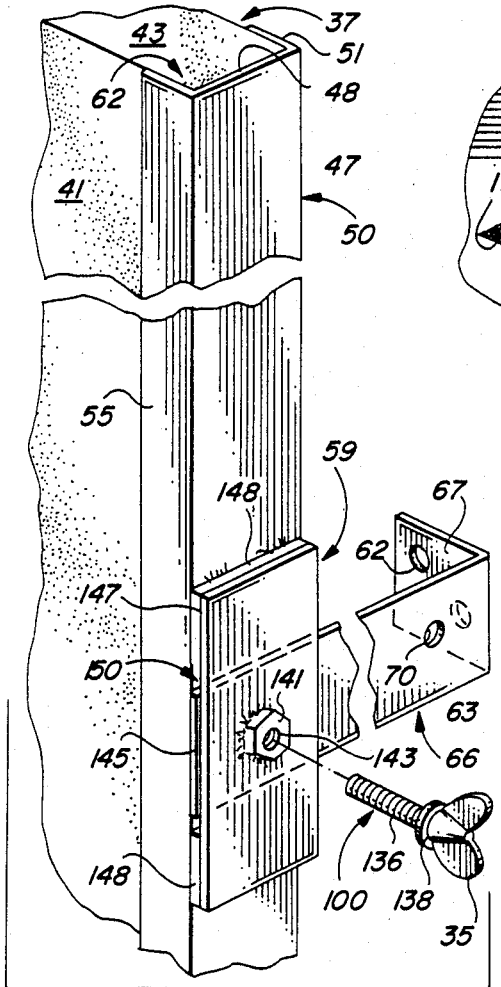
FIG. 4 is a partial perspective view illustrating the bracket assembly of the cover apparatus of FIG. 1.

FIG. 1 shows the cover apparatus 11 of the present invention as it is positioned about a conventional evaporative cooler 12. The cover apparatus 11 includes an upper or top insulating panel 13 being a top surface 15, a front edge 17, a rear edge 19, a first or right side edge 21, a second or left side edge 23, and a lower surface 25 which is adapted to be operatively disposed directly on and flush against the top 26 of the evaporative cooler 12. A mounting or hold-down assembly 27 is operatively disposed on the upper surface 15 of the top panel 13 for removably securing said top panel 13 to the top 26 of the evaporative cooler or swamp cooler 12. The hold-down apparatus 27 includes a first, generally rectangular, longitudinal member 23 having its opposite ends attached to opposite ends of the top 26 of the evaporative cooler 12 by fastening means, not shown, but known in the art, and winged nuts 35, which are relatively easy to unscrew, may be used for removing the hold-down fixture 27 to remove the top panel 15, if required. A second, generally rectangular, longitudinal member 31 is connected to the top surface 15 and through the body of the top insulating panel 13 and top to opposite ends or edges of the top 26 of the evaporative cooler 12 proximate the edge thereof. Again, the opposite end portions of the member 31 are threadedly coupled or connected to the top surface 26 of the evaporative cooler 12 by threaded members, not shown, but known in the art, and hereinafter described, the threaded end connected to winged nuts 35 for ease of removing hold-down assembly 27 if desired, for removing the top panel 13.

A cross bar or cross support member 29, which is another generally elongated, rectangular member extends between the midportions of the first and second members 33 and 31, respectively for interconnecting same. The opposite ends of the cross support bar 29 are fixedly connected to the midportions of the first and second members 33, 31, respectively, by any conventional fastening menas known in the art. In its assembled configuration, the hold-down assembly 27 has the first and second members 33 and 31, respectively positioned over opposite ends of the top surface 26 of the cooler 12 and the longitudinal axis of the members 33 and 31 being parallel to one another and to the adjacent sides of the evaporative cooler 12. The cross bar 29 has its longitudinal axis parallel with the front and rear edges of the cooler 12 and generally perpendicular to the axis of the longitudinal members 31 and 33. The hold down assembly 26 can be secured to the top panel 13 by fastener means at opposite ends of the pair of support members 31, 33, by fastening means through the cross member 29, or the like.

It will be observed that the dimensions of the top insulative panel 13 are significantly greater than the dimensions of the top 26 of the evaporative cooler 12 so that a substantial predetermined length of the end portions of the upper insulative panel 13 extend in all directions to substantially forward a predetermined distance from the plane of the sides of the evaporative cooler 12 to provide an overhang 83, 85 for providing shade to further cool the evaporative cooler 12 by shielding it from the direct rays of the sun and the like. In the preferred embodiment of the present invention, the top insulative panel 13 may be any desired thickness as required for the area in which it is used by typically is a 1½" or 2" panel composed of insulating material such as polyisocyanurate which is that manufactured by Thermal Systems or American Western. The superlative insulating properties of this material provide a relatively high K-factor and a high R-value for its thickness. Furthermore, the high isocyanurate/urethane combination makes it possible to achieve the highest degree of insulating efficiency for the lowest possible price of delivering extremely high insulation efficiency and maintaining a relatively thin panel. The material is dimensionally stable, has an unequalled low thermal conductively with an insulating value twice that of commonly used insulating materials and has a thermal resistance which means of energy efficiency. There is no degradation or desolving under normal conditions and it is unaffected by most aliphatics and aromatic solvents. The materila is extremely easy to apply since it is lightweight and easy to handle. It has a minimal moisture of permeability and a vapor barrier is needed only inextremely wet or damp atmospheres or in low temperature service. The closed cellular structure of the material makes water absorption and negligible, and since it has a high strength-to-weight ratio, its flrxural and sheer strength properties add additional structural strength to the panel. It has an extremely long life, and there is no evidence of deterioration over even long periods of time so as to provide an excellent service life with a minimum of maintenance. If is an odorless material; it does not absorb odors; and it resists most known fungus.

In the preferred embodiment of the present invention, the polyisocyanurate panel 13 and/or the side panels are provided with fiberglass facings which additionally enhance the rigidity and life of the panel.

The evaporative cooler 12 of the present inventionis operatively mounted or disposed on a base support menas 79 such as on the roof 80 of a dwelling or the like. the evaporative cooler 12 has a top 26, a front side 71, a left side 73, a right side 75, and a bottom 151 which is operatively disposed upon the base support means 79. It also has a rear side, which is not shown, but which is substantially identical to each of the other sides. Each of the sides of a midportion which is provided with a plurality of vents 77 for communicating the interior of the evaporative cooler 12 with the atmosphere. As previously described, the sides 71, 73 and 75 are shaded for additional cooling effects by the overhangs 81, 85, and 83 provided by the extended undersides of the top panel 13. Additionally, the outer peripheral edge portion of each of sides is provided with a seal composed of foam rubber material 90 or the like which extends completely around the midportion of each of the sides.

Each of the sides of the evaporative cooler 12 is provided with insulating side panel, such as illustrated by side panels 37 and 39 for shielding the sides 73 and 75, respectively of the evaporative cooler 12 of FIG. 1. The side panel 37 includes an upper edge 43, a lowre edge 45, a rear edge 49, and a front edge 37. The opposite panel 39 has its edges similarly designated by like reference numerals. While the top and bottom edges 43 and 45 of each of the panels 37 and 39, respectively, is not covered, front and rear edges 47 and 49, respectively, are closed within a generally U-shaped squared channel 20 having edges 55 and a top or outer surface 56 the side edges 47 and 49 of each of the side panels 37 and 39 fitted within the slotted channel within the generally squared U-shaped members 50 which are made of aluminum or galvanized metal. Alternatively, a trianular edging of reinforced fiberglass can be substituted for the U-shaped channels and provided with slots for receiving the bracket arms 61 therethrough. Since the edges 47 ad 48 of the side panels 37 and 39 are fitted within the channels of the U-shaped members 50, the bottoms of the channels are crimped to keep the panels from sliding down. Bracket pressure, as hereinafter described, then holds them firmly in place, and no metal channels are required on the top and bottom edges 43 and 45 of the panels 37 and 39 since the problem does not arise.

Conventional materials were tested for the top panel 13, such as polystyrene, but the lack of rigidity, the tendency to decompose or flake off in less than a three year period by direct exposure to the elements, and the like rendered such material useless for this purpose. Furthermore, plastic honeycomb panels of various sorts were tried for the side panels but were found unsatisfactory due to water flow through the material would occur in streaks leaving many of the pads in the cooler bone dry.

A midportion of each of the side edges 56 of the U-shaped channel-forming members 50 are sides 47 and 49 of the side panels 37 and 39, respectively, are provided with a metal plate 59. The metal plate is provided with a threaded aperture for receiving a threaded fastener as hereinafter described. A bracket assembly 61 is a generally rectangular L-shaped member having a short leg 65 provided with one or more apertures for securely fixedly fastening bracke 61 to a midportion of the sides 73 and 75 of the evaporative cooler 12 proximate a midportion or vertical length thereof that the outer peripheral edges of both sides. The plane of the end portion 65 is flush against and parallel to the wcterior surfaces 73 and 75 of the cooler 12, and the elongated, generally rectangular leg portion 63 of the bracket 61 is integral with the portion 65 and extends generally perpendicular thereto and perpendicular to the plane of the sides 73 and 75 of the cooler 12. Proximate the outer end portion of the long leg member 63 is provided a first aperture for receiving a threaded member therethrough to secure the outer end of the bracket to threaded fastener provided in plate 59 and connecting it thereto as by fasteners 35. A second aperture 70 is provided the opposite end portion of the elongated member 63 proximate the short end leg 65 for use as hereinafter described.

When each of the side panels 37, 39 are operably coupled to the brackets 61, they are positioned a predetermined distance away from the sides 73, 75, respectively of the evaporative cooler 12 by a fastener 35 connected through the first or outer aperture 72 of the leg 63 of bracket 61. This positions the plane of the side panels 37 and 39 generally parllel to the plane of the sides 73 and 75, respectively, of the evaporative cooler 12. The predetermined distance away from the sides of the evaporative cooler 73 and 75 at which the interior surface 51 of the panels 37 and 39 are placed, form an air space 87 and 89 between the inside surface 51 of thepanel 37 and 39 and the exterior surface of the sides 73 and 75 of the evaporative cooler 12. Therefore, the bracket assebmly 61 enables the side panels 37 and 39 to be positioned a predetermined distance away from the sides 73 and 75 of the cooler 12 during the cooling season for providing shade to the cooler 12; for minimizing heat absorption through each of conduction, convection and radiation; and for providing space for air circulation about the cooler.

In the preferred embodiment, the predetermined distance between the exterior surface of the side 73 and 75 of the cooler 12 and th einterior surface 51 of the side panesl 37 and 39 is at least five inches to allow complete and free air flow to the cooler pads. The space is also provided at the top and bottom of the panels 37 and 39 so that sufficient air flow is assured to the spaces 87 and 89. The actual square area of the cooler intake grills or vents 37 is effectually reduced about 50% due to the structure of th epads and since the squared area between the side panels 37, 39 and cooler shell 73, 75 is more than sufficient allow free air flow into the unit.

In the winter, during the heating season, the threaded fasteners 59 can be removed and the panels 37 and 39 repositioned or retracted so that the fastener 35 can be reinserted through aperture 70 to secure the inside surface 51 of the pads 37 and 39 flush against the side 73 and 75 of the cooler 12. The seal about the peripheral edge of the midporton containing the vent 77 will intereact with the inner surface of the pads 37 and 39 so as to provide an airtight seal about the vents 77 of the evaporative cooler 12. The invention provides a dual purpose or dual function operation for preventing heat loss in the winter or heating season and saving energy together with heating and the cooling effect and saving energy and reducing fuel consumption in the cooling season, are the prime and unique features of Applicant's cover apparatus 13. It will, of course, be recognized that while side panels 37, 38 have been shown and described in FIG. 1, that similar side panels or front and rear panels would also be similarly connected over the front and side 71 of the evaporative cooler and the rear or opposite side which is not shown.

FIG. 2 shows a portion of FIG. 1 in greater detail. In FIG. 2, the top insulating panel 13 its end portion or outer peripheral edge 22 is sending a predetermined distance beyond the outside surface 113 of the side 75 of the evaporative cooler 12 of FIG. 1. The outwardly extending end portion 22 of the panel 13 provides the overang 85 previously described, and it will be seen that the outer end 21 of panel 13 is provided with a fiberglass facing 18 which is actually contained on all four sides 17, 19, 21, and 23 of the sides or edge portions of the upper insulating panel 13. It will be seen that the hold-down mechanism 27 of FIG. 1 is shown as having forward end portions the elongated member 33 secured to the upper or top surface 15 of the top panel 13 and apertured through front portion of the member 33 and through the panel 13 receives a threaded fastener member 90 having a head portion 95 disposed within the interior of the evaporative cooler 12 and elongated portion 91 passing through the top 97 of the evaporative cooler 12 through a correspondingly aligned aperture of the top panel 13 and the aperture of the member 33 so that the wing nut or internally threaded member 35 is received on thethreaded end portion 93 of the elongated body 91 of the fastener 90 and threadedly received thereon and tightened so as to clamp the lower surface 25 of the top panel 13 tightly against the upper surface 98 of the top 97 of the evaporative cooler 12 of the present invention.

It wil further be seen that the relatively short arm 67 of the bracket assembly 66 is flush against and attached to the outside surface 115 of the side 75 of the cooler 12 and fastened therein by threaded fasteners or any conventional fastening device 64 passing through the aperture or apertures within the short leg member 67. Simultaneously, the first aperture at the end farthest from the short leg 67 and the long leg 69 is attached by an elongated threaded member 35 to the internally threaded aperture of the plate 117 so as to secure the side panel 39 of the bracket 66 so that the panel 39 is generally parallel to the outside surface 115 of the side 75 of the cooler 12 and spaced a predetermined distance "d1" therefrom. It will also be noted the panel 101 includes a top surface 103 of the panel 101 and the exterior surface 109, and interior surface 111, a midportion 107 to which the plate 117 is secured. The upper surface 103 is substantially planar and spaced a predetermined distance "d2" from the undersurface or lower surface 25.

The overhang 85 is created by the end portion 22 of the top panel 13 so as to provide a gap or air flow path 105 between top panel 13 and the top 103 of the side panel 101 for air flow into the space 113 between the interior surface 111 of the panel 101 and the outside surface 115 of the side 75 of the cooler 12. The distance "d1" is at least a recommended distance of five inches and the distance "d2" is slightly less, sufficient space will have been allowed for a complete and free air flow into the cooler pads of the evaporative cooler 12. Space is not only provided at the top 105 above the top 103 via space 105 but is also provided the bottom of the panels, as hereinafter described, so that more than sufficient air flow is assured during the cooling season. As conventionally known, the actual squared area of the cooling intake vents 77 is reduced to about 50% of its normal area due to the structure of conventional aspen pads used in evaporative coolers today. Therefore, the squared area between cooler pads and the cover panels and the outside shell of the evaporative cooler is more than sufficient to allow a free flow of air into the unit during the cooling season.

Similarly, during the heating season, the wing nut or fastener 35 is removed and the panel 101 is retracted or repositioned flush against the outside or exterior surface 115 of the side 75 of the evaporative cooler 12 and the threaded fastener 35 is passed through the aperture 70 into the threaded aperture of the plate 117 to securely fix the position of the panel 101 at that position. The seal between the inside surface 111 of the panel 101 and the inside surface 115 of the cooler 12 is insured by the use of the foam rubber seal 90 on the outside of the midportion of the side 75 containing the louvers or vents 77 so as to totally enclose the cover of the mid portion to prevent the escape of heat therefrom.

FIG. 3 illustrates the lower end of the panel 39 in the evaporative cooler 12 and shows the connection of the outer end 12 of the side panel 39 disposed within the channel 62 formed by the generally squared U-shaped channel member 59 which faces the front and rear sides or ends of the panel 39. It will be observed that the connector 35 including a stem portion 119 and a nut-like member 118 is secured in the first aperture 72 of bracket 66 at the elongated member 119 extends through the outer metal facing 59 and into the metal plate 59 to secure the bracket 66 or the end portion of the long leg 63 of the bracket 66 securely to the metal plate 59 at the mid portion of the outer edge 37 of the panel 39.

It will be seen that while some of the heat passes through the panel 39, much of the heat is reflected therefrom. Furthermore, once the heat enters the space 39, the space 89 is cooled from the air passing through the space 105 about the space 113 and further cooling the air which then passes into the intake vents or grill 77 within the portions 129 of the face 71 of the cooler 12 and into the interior 120 thereof. It will aslo be seen that the short leg 123 of the bracket assembly 66 is secured flush against the outside or exterior surface of the side 75 of the cooler 12 and fastening by conventional nut and bolt fasteners 125, 127.

It will be seen that if the threaded member 119 is removed from the aperture or plate 59 by turning the wing nut portion and bolt 35, 118, respectively, the threaded member 119 can be removed from the aperture 72 and thepanel 39 can be retracted or repositioned rearwardly flush against the outer surface 115 of the side 75 of the cooler 12 and secured in this position to provide an air tight seal over the vents 77. The panels 39 are secured in this location by reinserting the elongated fastener member through aperture 62 and fastening the nut and wing nut combination 118 and 135 thereto for securing the central portion of the panel 37, 39 via the plate 59 of the panel 39 in a sealing or closed position for use in the heating season to prevent the escape of warm air from the interior of the dwelling via the up duct to the evaporative cooler 12 and vents 77.

FIG. 4 illustrates a side panel 37 having a top surface 43 with an end surface 48. The end surface 48 is received within the U-shaped channel 62 formed by the facing 50 having an elongated portion 47 sized to receive the end of the panel 37 therein and a pair of short side leg portions 51 for forming the channel 62 therebetween. Preferably, the U-shaped channel 50 includes galvanized metal or aluminum. The sides 55 of the channel forming member 50 extends substantially the length of the member 62 of the panel 37. The fastener plate 59 is shown as being fixedly attached to the midportion of the channel 50 by any conventional means, and the strip is shown, in FIG. 4, as including a back-up plate or shim 148 disposed on opposite ends of the actual midportion so as to form a hollow space or channel 150 between the upper and lower shims 148. The generally rectangular elongated metal plate 59 has its outer edge flush with the shim and the sides 55 of the U-shaped channel member 50 is a nut-like member 141 that iswelded or other wise secured to the midportion of the plate 59 and provided with an internally threaded aperture 143 for receiving a threaded fastening device as conventionally known. The fastening device 100 is shown as including an elongated threaded stem portion 136, a nut-like, upper, interconnecting portion 138 and a wing nut or outer portion 35 adapted to be engaged easily between a user's fingers and turned for threading the member 136 into the aperture 143 through the outer aperture 72 of the leg 63 of the bracket 66 for turning the member 166 in the opposite direction for removing it therefrom for repositioning the panel as previously described.

In the embodiment of FIG. 4, it will be seen that the bracket assembly 66 can easily be repositioned simply by removing the fastener member 100 and sliding the body of the elongated leg 63 of the bracket 66 through the aperture 150 formed between the shim members 148 until the inner most aperture 70 adjacent the plate 67 is aligned with the threaded aperture 143 of the fastener 141. At this point, the threaded portion 136 of the fastener 100 is threaded back into the aperture 143 of the nut member 141 and passes through the aperture 70 to securely lock or position the panel 37 flush against the outer surface 115 of the evaporative cooler 12 so that the inner surface 51 of the panel 39 cooperates with the foam rubber seal 90 located about the mid portion containing the louvers or vents 77 to provide an air tight seal and terminate or at least greatly reduce the heat loss of the interior of the dwelling which would normally occur through the evaporative cooler 12 absent the apparatus 11 of the present invention.

Figure 5:
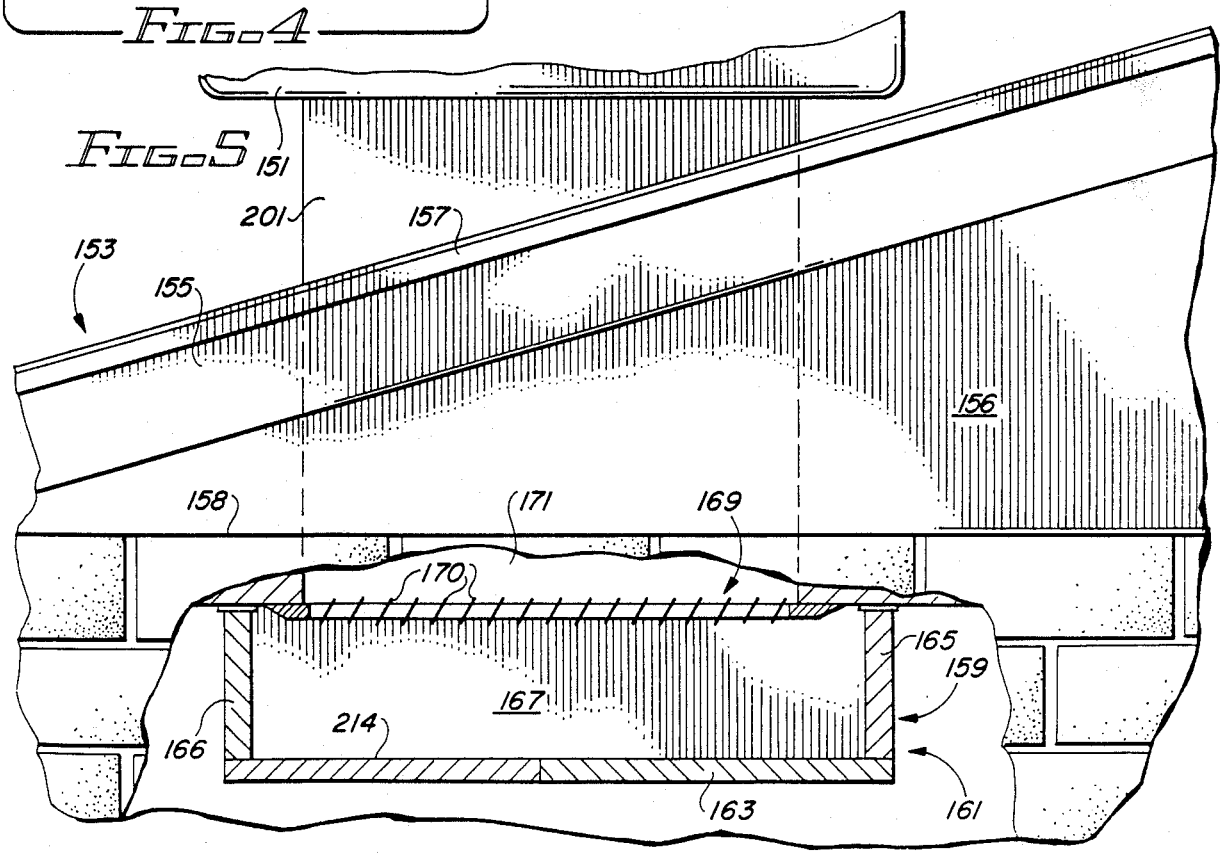
FIG. 5 is a plan view, partially broken away and sectioned, illustrating the vent cover apparatus of the present invention.

FIG. 5 shows a roof-mounted evaporative cooler 12 mounted on a base support 151 and having a down duct 201 passing through the roof 157 of the dwelling 153 and through the roof support members 155 into the attic or crawl space 156 and through the ceiling 158 of a particular room 159 within the dwelling 153. As conventioally known, the lower end of the down duct 201 terminates in a register, in the present example, a ceiling register or vent 169 having a plurality of vent members 170 which can be manually turned to an open position to admit cool air from the down duct 201 into a room 159 of the dwelling 153 during the cooling season. These vent members 170 can be rotated to close to at least reduce the heat loss from the room 159 via the duct 201 in the heating season. However, by merely closing the metal vents 170 in the register 169, or even by covering up the evaporative cooler 12 on theroof with a canvas or plastic cover, the effect is t heat a tent up on the roof and estimates show that such heat loss is equivalent to at least heating an extra roomin the dwelling. Thus 1/6–¼ of the heat bill is going to heat this tent and the great outdoors.

Figure 6:
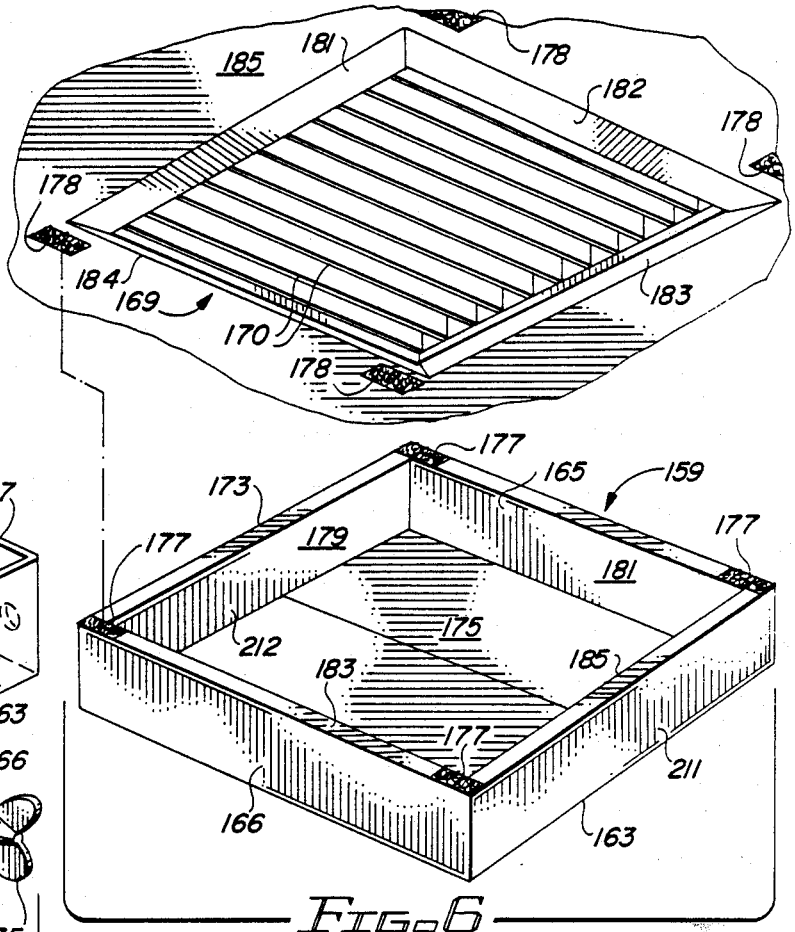
FIG. 6 is a perspective view, illustrating the ceiling vent and cover therefore of the present invention.

In the preferred embodiment of thepresent invention illustrated in FIGS. 5 and 6, the ceiling is provided with fastening means whose corresponding portion is connected to the corners of register cover 159. In the preferred embodiment, a plurality of at least oen of male hook and female loop type fastening means 178 are secured, as by an adhesive or the like to the ceiling 185 at opposite corners or ends of the low portion 169. Corresponding fastener members 77 including the opposite male hook and female loop type fastener members 178 are secured to portion,s for example the corners, of the vent or grill cover 159 for matedly fastening purposes as hereinafter described. As shown in FIGS. 5 and 6, the vent cover 159 includes generally square or rectangular lower insulating panel portion 163 and four generally elongated rectangular sides 165, 166, 211 and 212. Each of the sides 165, 166, 211 and 212 include an interior surface 181, 183, 185, and 179, respectively, facing an open interior portion 175 bounded only by the upper surface 214 of the bottom panel 163.

In effect, the vent cover 159 is a generally box-like structure including the bottom 163 and the four sides 165, 166, 211 and 212 the side opposite the bottom 163 open to the interior 175 to provide an insulating air space which is positioned direectly over the vent 69. At least one of male or female hook and loop type fasteners 177 are adhesively or otherwise conventionally secured to corner portions of the box-like structure on the top edge of each of the sides or adjacent sides in the four corners an these are adapted to be received by the other of the male hook and female loop type fasteners pads 178 on the ceiling so that the relatively lightweight cover 159 can be pressed to pads 177 aligned to the pads 178 and removably secured to the ceiling 185 to entirely cover and insulate the vent 169 to prevent heat loss then the interior room 161 of the dwelling 153 which would normalize pass even through the closed register vent members 170 and pass through the duct 201 into the atmosphere through the evaporative cooler 12.

In FIG. 6, it will be seen that vent members 170 of the vent or grill work of the ceiling register 169 bounded by sides 181, 182, 183 and 184 and thedimensions of the register are significantly smaller and the interior space within the sides 165, 166, 211 and 212 of the box-like structure of the register cover apparatus 159 of the present invention so that the entire structure of the grill 169 is contained within the sides of the vent cover 159 with a closed, dead air space 175 being positioned over the vents 170 to minimize and greatly reduce the heat loss during the heating season.

It will be recognized to those skilled in the art that various modifications, alteration, substitutions and variations can be made in the structure, materials, positioning, dimension,s and specific structural features described herein without departing from the spirit and scope of the present invention which is limited only the appended claims.

I claim:

1. A cover for an evaporative cooler having a top, a bottom operably disposed on a base support means, and four generally rectangular dies having a plurality of vent means for communicating the interior of the evaporative cooler to the atmosphere, said cover comprising:

a top panel of insulating material dimensioned substantially greater than the top surface of said evaporative cooler for providing a substantial overhand about the four sides of the evaporative cooler for shading same;

menas for operatively coupling said top panel to the top of said evaporative cooler;

four generally rectangular insulating side panels;

a pair of bracket means operably dispoed on opposite ends of each side of said evaporative cooler for operatively mounting each of said side panels a predetermined distance away from a corresponding side of the evaporative cooler with the plane of the side panel being substantially parllel to the plane of corresponding side of evaporative cooler; and manually operably means carried by said bracket means for repositioning each of said four insulating side panels flush against corresponding sides of the evaporative cooler for sealably covering at least a vented portion thereof for insulating the evaporative cooler during the heating season.

2. The cover of claim 1 wherein said top panel and said side panels form a means for conserving fuel while simultaneously providing cooler air to increase the comfort level of a dwelling provided with the evaporative cooler.

3. The cover of claim 1 wherein said bracket means includes means for enabling each of said panels to be spaced a predetermined distance away from the sides of the evaporative cooler during the cooling season for conserving energy and providing cooler air to increase the comfort level in the dwelling, said bracket means enabling said panels to be repositionable for flush against the sides of the cooler insulating the cooler during the heating season to futher conserve fuel and to prevent the escape of warm air from the dwelling during the heat season.

4. The cover of claim 1 wherein each of said bracket means includes a generally squared L-shaped bracket having a first short leg having at least one aperture therein and a second relatively long leg having a first aperture at oen end thereof and a second aperture at the opposite end thereof adjacent said short leg, a bracket means including a threaded member passing through said first aperture for and securing said bracket means to the end of one of said side panels, said threaded member being manually removable for releasing said side panel and enabling it to be manually repositioned flush against a side of the evaporative cooler and re-fastening same in a sealing relationship to the air vent portions of said cooler by replacing said threadedd means through said second aperture for securing said side panel for sealing position.

5. The cover of claim 1 wherein each of the sides of said evaporative cooler include a foam rubber sea substantially around the vented mid portion thereof for sealing the evaporative cooler in an air tight manner when the side panel is manually repositioned flush agsint the side of the evaporative cooler in the heating season.

6. The cover of claim 1 wherein said top panel includes a polyisocyanurate structure having fiberglass facings and each of said side panels includes polyisocyanurate insulating material.

7. The cover of claim 1 wherein each of said side panels are fitted into a U-shaped channel manufactured from at least one of aluminum and galvanized metal and the bottom of said channel is crimped to keep the panels from sliding downward therein such that said bracket means holds the panels firmly inplace.

8. The cover of claim 1 wherein said top cover is approximately two inches thick and each of said side panels is approximately one inch thick.

9. The cover of claim 1 wherein height of said side panels is substantially such that top portion of each side panel terminates a predetermined distance below the overhang of siad top panel for providing an air flow over the side panels and into the evaporative cooler during cooling operations.

10. The cover of claim 1 wherein the means for operatively coupling said panel to the top of said evaporative cooler includes a first elongated member fixedly secured through the top panel and into the top of the evaporative cooler, for operatively clamping the top panel to the cooler; a second elongated member operatively coupled through siad top panel to the top of said cooler for operatively clamping the top panel thereto and a corss brace member generally perpendicular to first and second elongated members and connecting the mid portions thereof for forming a handle means for removing the top panel after the threaded fastener means are manually removed.

11. The evaporative cooler cover of claim 1 further comprising:

a down duct operatively coupled to said evaporative cooler and extending substantially downward into a room of the dwelling provided therewith;

an overhead ventilation ceiling duct connected to the lower end of said down duct and communicating with an outlet in the ceiling of said room;

an overhead ceiling vent apparatus operably disposed in said ceiling outlet of said ceiling duct for supplying cooler air into said room during the cooling season; and a ceiling-mountable vent cover means for selectably, sealably closing said overhead ceiling vent apparatus in the heating season for preventing the escape of warm heated air from at least said room of said dwelling.

12. The evaporative cooler cover of claim 11 wherein said ceiling-mountable vent cover means for selectively sealably closing said overhead ceiling vent apparatus comprising:

a generally box-like assembly having four sides operatively coupled to one another at their ends for forming a generally rectangular frame structure, and a bottom panel operatively coupled over the bottom of said frame structure for providing a five-sided geometric figure having an open top end communicating with a hollow base interior operatively bounded by said four sides, and said bottom panel;

the top edge surfaces at the open end of said box-like ventilation assembly including a first plurality of at least one of male hook members and female loop members operatively disposed and fixedly secured to said top edge surfaces of said four sides of the open top end of said box-like assembly proximate the corners thereof; and a second plurality of the other of said at least one of male hook members and female loop members operatively disposed on and fixedly secured to the ceiling at least adjacent the corner portios of said overhead ceiling down vent apparatus of a room of the dwelling of a room of the dwelling having said evaporative cooler operatively mounted on the roof thereof;

said male hook and female loop members being operatively connectable by manually pressing said box-like assembly upward against the ceiling of the room about the overhead ceiling apparatus to readily releasably interconnect said first and second pluralities of male hook members and female loop members for removably attaching said box-like assembly over said overhead ceiling vent apparatus, said box-like assembly being removable by manually pulling downward on said box-like apparatus to separate the male hook and female loop members apart for uncovering the ceiling down vent.

13. The evaporative cooler cover of claim 12 wherein each of the four sides and the bottom panel of said box-like assembly includes insulating material.

14. The cover assembly of claim 13 wherein said insulating material includes polyisocyanurate material.

15. A repositionable, energy efficient, cover means for an evaporative cooler having a top, a bottom, and four sides, each of the sides having a mid portion which includes a plurality of venting means for communicating the interior of the evaporative cooler to atmosphere, said cover means including:

a relatively large, generally rectangular top insulating panel means having its sides at least a predetermined length longer than the sides of the top of the evaporative cooler for providing a substantial overhang beyond each of the sides of the top portion of the evaporative cooler for shading purposes;

four side insulating panels operatively disposed to cover at least the mid portion of each of the corresponding four sides of the evaporative cooler;

means for operatively mounting each of said side panels a predetermined distance away from a corresponding side of the evaporative cooler such that the plane of the side panel is parallel to the corresponding side of the evaporative cooler and spaced a predetermined distance therefrom for conserving energy shile simultaneously increasing the cooling effect of the evaporative cooler during the cooler season; and said mounting means including means for manually removing each of said side panels and repositioning same flush against the corresponding sides of said evaporative cooler for sealing at least the vented mid portions thereof in an air tight manner for preventing the loss of heat therefrom during the heating season.

16. The cover means of claim 15 wherein each of the sides of the evaporative cooler include a generlly rectangular foam rubber shield outward of the vented mid portion thereof such that when side insulating panel is repositioned flush against the corresponding sides of said evaporative cooler, an air tight seal exists over the vented midportion of evaporation cooler sides.

17. The cover means of claim 15 wherein said top insulating panel includes polyisocyanurate and each of said side insulating panels include polyisocyanurate insulating material.

18. The cover means of claim 17 wherein said top panel is substantially twice as thick as each of said side panels.

19. The cover means of claim 17 wherein said side panels are approximately one inch thick.

20. The cover means of claim 15 wherein the bottom of said evaporative cooler is connected to the interior of the room within the dwelling provided with the cooler through a duct to a ventilation port within the room, said cover means further including ventilation port cover menas for substantially sealing said ventilation port during the heating season to prevent the escape of heat from said dwelling.

21. The cover means of claim 20 wherein said ventilation port cover means includes generally rectangular bottom panel dimensioned slightly greater than the dimensions of said vented port for covering same, four sides operatively depending upon the four edges of said bottom panel for forming a box-like structure having one side open to the hollow interior space between said sides, the edges of said side panels opposite the edges of said bottom panel and provided with at least one of male and female hook and loop fastener means at the corners thereof and the saling of the dwelling being provided with the opposite of said at least one of hook nad loop fasteners disposed upwardly proximate the corners of the ventilation port for operative connecting the top edges of the sides of the vent port cover to the ceiling for closing the vent to prevent the escape of heat in the dwelling and for separating the hook and loop fastener means for removing the ventilation port cover during the cooling season.

* * * * *